United States Patent [19]

Augustin

[11] Patent Number: 4,658,784

[45] Date of Patent: Apr. 21, 1987

[54] MECHANICAL INJECTION PUMP GOVERNOR

[75] Inventor: Ulrich Augustin, Kernen, Fed. Rep. of Germany

[73] Assignee: Daimler-Benz Aktiengesellschaft, Fed. Rep. of Germany

[21] Appl. No.: 744,994

[22] Filed: Jun. 17, 1985

[30] Foreign Application Priority Data

Jun. 16, 1984 [DE] Fed. Rep. of Germany ..... 3422445

[51] Int. Cl.[4] ..... F02M 39/00

[52] U.S. Cl. ..... 123/383; 123/372

[58] Field of Search ..... 123/383, 382, 364, 372

[56] References Cited

U.S. PATENT DOCUMENTS

| | | | |
|---|---|---|---|
| 4,149,507 | 4/1979 | Little | 123/383 |
| 4,343,276 | 8/1982 | Jaliwala | 123/383 |
| 4,416,233 | 11/1983 | Straubel | 123/383 |
| 4,441,472 | 4/1984 | Knorreck | 123/383 |
| 4,534,329 | 8/1985 | Filtri | 123/383 |

FOREIGN PATENT DOCUMENTS

| | | | |
|---|---|---|---|
| 3246869 | 7/1983 | Fed. Rep. of Germany | 123/383 |

*Primary Examiner*—Carl Stuart Miller

*Attorney, Agent, or Firm*—Barnes & Thornburg

[57] ABSTRACT

A mechanical injection pump governor is provided having a first adapting device which acts in the lower speed range up to the full-load characteristic curve of a supercharged diesel engine for adapting the delivery quantity of the injection pump to the fuel requirement of the diesel engine. The adapting device contains a spring-loaded diaphragm which is acted upon by a supercharge and is connected to the control rod of the injection pump. The lift of the diaphragm, when supercharge pressure is applied, is limited by a full load stop which determines the adapting end point. To improve the torque profile of the diesel engine, a second adapting device is provided which adjusts the full load stop. By means of this second adapting device, the full load stop can be displaced against an additional spring force when supercharge pressure is progressively applied so that the delivery quantity of the injection pump increases between the adapting end point and the rated speed of the diesel engine.

13 Claims, 4 Drawing Figures

MECHANICAL INJECTION PUMP GOVERNOR

BACKGROUND AND SUMMARY OF THE INVENTION

The present invention relates generally to a mechanical injection pump governor. More particularly, the governor has a negative adapting device which functions from the lower speed range up to the full-load characteristic curve of a supercharged diesel engine for automatically matching the delivery quantity of the injection pump to the fuel requirement of the diesel engine.

In supercharged diesel engines, it is known to match the delivery or full-load quantity to the supercharge pressure. As the supercharge pressure available in the lower speed range is lower and consequently the weight of the air charge in the engine cylinder is less, the full-load quantity is matched to the reduced air weight by the supercharge-pressure-dependent adaptor. In other words, the delivery quantity is reduced or negatively adapted in the lower speed range.

Such a supercharge-pressure-dependent adapting device is disclosed in German Offenlegungsschrift No. 3,137,145. By means of this adapting device (FIG. 2, between C and a point D on the full-load characteristic curve), the full-load quantity is adapted to the supercharge pressure, which at first is too low.

An object of the present invention is the provision of an adapting device of the general type mentioned above, which is in operative connection with the injection pump governor such that it exhibits an improved torque profile through simple constructive means. Another object of the present invention is the provision of an improved adapting device which functions without exerting an influence on the supercharge pressure-dependent adaptation acting below the full-load characteristic curve.

These and other objects of the present invention are attained by adapting means for providing adjusting full load stop means when supercharge pressure force is applied to control rod means.

In conjunction with the standard, so-called negative adaptation, a further adaptation which acts independently of the negative adaptation is thus attained in a simple manner. In the torque performance graph, this means that the torque profile does not fall from maximum torque at increasing speed but is maintained over a certain speed range. This has an advantageous effect on the fuel consumption, because the power output remains at least approximately constant over a certain range as will be explained in the detailed description. Because of the special torque profile, it is possible to drive without changing gears frequently.

In one embodiment, a control rod travel characteristic curve is obtained which constantly increases from the adapting end-point of the negative adaptation up to the rated speed. In another embodiment, the control rod travel characteristic curve increases at a distance from the adapting end point of the negative adaptation up to the rated speed. In a further development adjustment of the adapting devices, adjusting work, for example, raising or lowering the full-load level, can be easily accomplished due to the special location of the second adapting device in conjunction with the first adapting device.

Other objects, advantages and novel features of the present invention will become apparent from the following detailed description of the invention when considered in conjunction with the accompanying drawings.

DETAILED DESCRIPTION OF THE DRAWINGS

Figure 1:
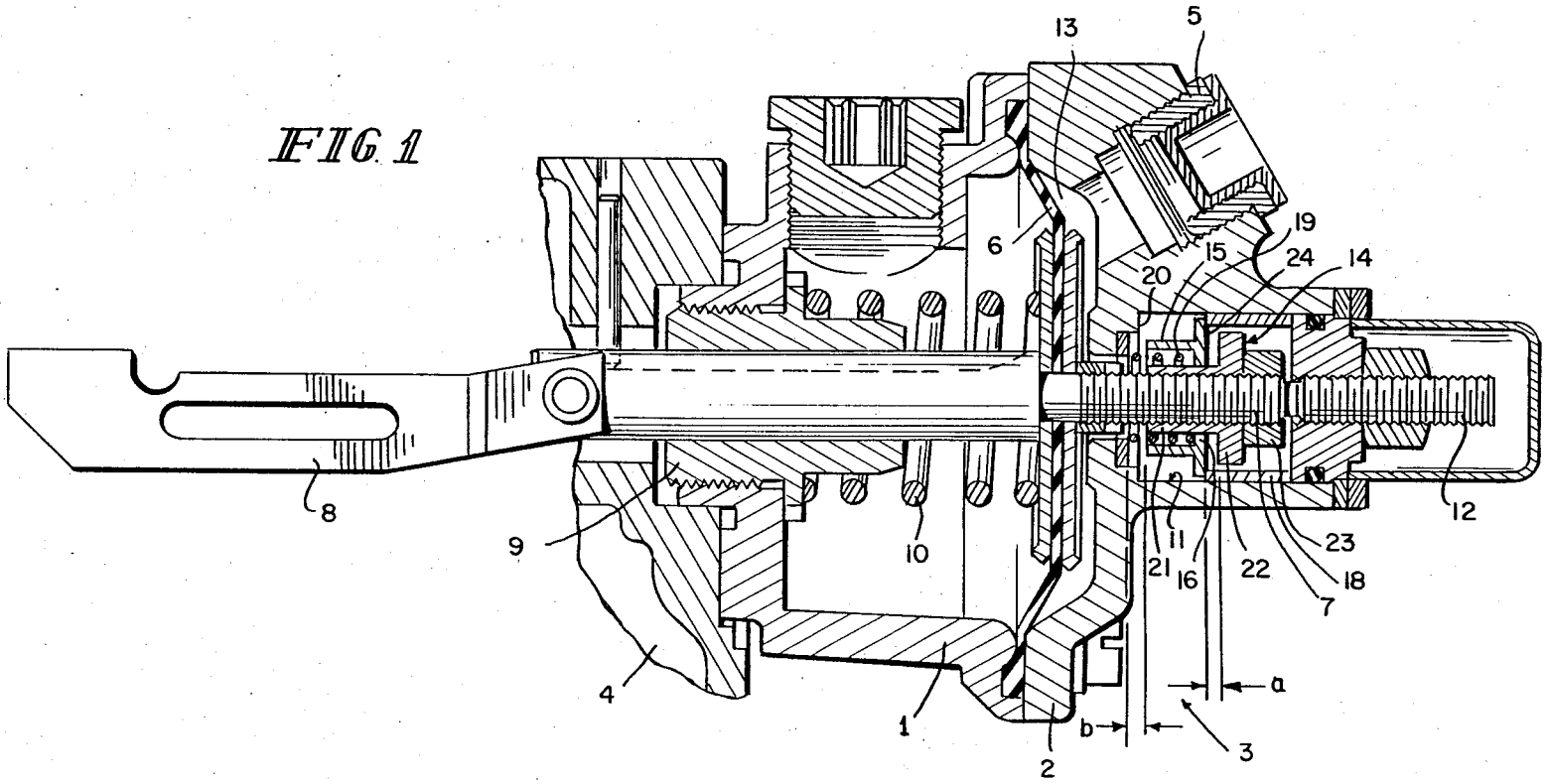
FIG. 1 is a sectional schematic view which shows an adapting device according to a first preferred embodiment of the present invention, having a pre-tensioned stop bush as a movable full-load stop.
Figure 2:
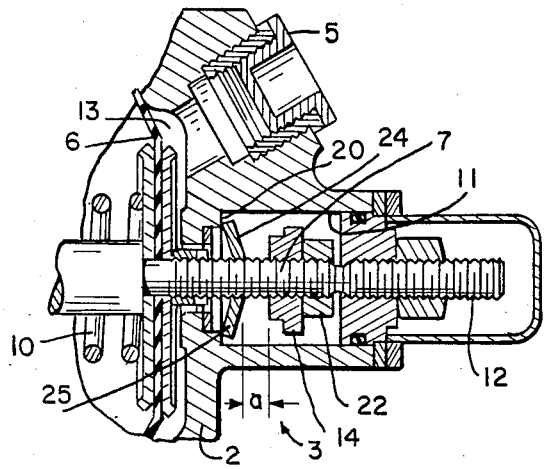
FIG. 2 is a sectional schematic view which shows an adapting device according to another embodiment of the present invention, having a plate spring as a movable full-load stop.

FIGS. 1 and 2 show a construction unit 3 which consists of a housing 1 and a cover 2 and is fixed to an injection pump governor 4 provided for supercharged diesel engines. A diaphragm 6 is clamped air-tight between the housing 1 and the cover 2 which has a connecting fixture 5 for applying supercharger pressure. The diaphragm 6 is firmly arranged on a stud bolt 7 which is connected to the control rod of the injection pump (not shown) by a strap 8.

The stud bolt 7 is mounted in a longitudinally displaceable manner in a guide bush 9 which additionally acts as a support for a compression spring 10 which is disposed against the diaphragm 6. On the opposite side of the diaphragm 6, the stud bolt 7 projects into a cylindrical recess of the cover 2 and is disposed in this location against an adjustable grub screw 12. The position shown indicates the initial position before supercharge pressure is applied. When the diaphragm 6 in the chamber 13 is acted upon by supercharge pressure, the stud bolt 7 moves against the force of the compression spring 10 and acts via the strap 8 on the control rod of the injection pump. The travel of the stud bolt 7 is limited by a follower 14 firmly arranged on the stud bolt 7. This follower 14 abuts against a full-load stop 15.

By means of this standard adapting device, the delivery quantity of the injection pump is automatically matched or adapted to the fuel requirement of a supercharged diesel engine. Because of this negative adaptation, the full-delivery quantity is not available first at increasing speed in the lower speed range, but is adapted to the increasing supercharge pressure. Negative adaptation is complete at speeds of about 1000 revs/min (see the control-rod travel profile according to FIG. 3).

In addition to this known adapting device, according to the present invention a second adapting device is also integrated into construction unit 3. This second adapting device increases the torque profile between the adapting end-point on the full-load characteristic curve and the rated speed of the diesel engine (the increase in the torque profile is indicated by the continuous characteristic curve "mA" in FIG. 4).

In FIG. 1, the full-load stop designed as a stop bushing 15 is arranged in the cylindrical recess 11 of the cover 2 and mounted in a longitudinally displaceable manner on the stud bolt 7. The stop bushing 15 has an inner collar 16 and an outer collar 17. The outer collar 17, by means of a compression spring 19 which is guided inside the stop bushing 15, sits under pre-tension against a bushing 18 which is fixed in position in the recess 11. The compression spring 19 is supported on one side against the cover wall 20 and on the other side against the inner collar 16. The follower 14 is formed by a spacer nut which has a cylindrical part 21 with a stop collar 22. A lock nut is designated 23.

Figure 3:
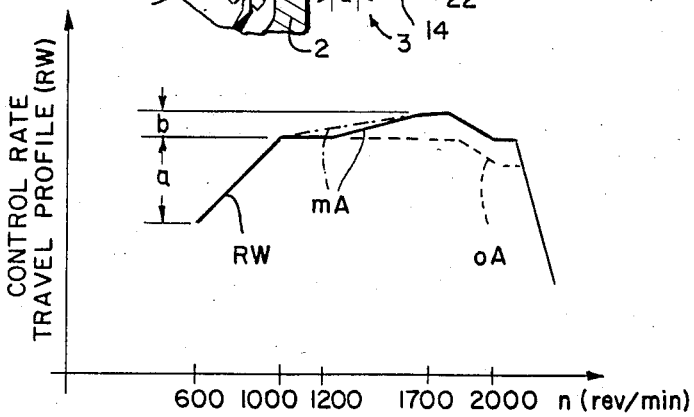
FIG. 3 is a graphical depiction which shows a control rod travel profile at increasing speed for both illustrative embodiments according to the present invention and also the profile without adaptation.

When the diaphragm 6 is acted upon by supercharge pressure, the stud bolt 7, together with the follower 14, moves to the left (see FIG. 1) against the force of the compression spring 10. After a control travel (indicated in FIG. 1 by "a") has been covered, follower 14 with its stop collar 22 abuts against a surface 24 of the stop bushing 15. According to FIG. 3, this travel "a" corresponds fo the negative adaptation characteristic curve between the speeds of about 600 and 1,000 rev/min. After the adapting end-point, the control travel does not change at first, in spite of increasing speed and increasing supercharge pressure, because of the pretension force of the compression spring 19. Only after a speed of about 1,200 rev/min do the stud bolt 7 and the stop bushing 15 move further to the left via the stop collar 22 of the follower 14, until the stop bushing 15 abutts against the cover wall 20 after a control travel (indicated in FIG. 1 by "b") has been covered as shown in FIG. 3 which occurs at a speed of about 1,700 rev/-min.

The continuous characteristic curve in the speed range from 1,200 to 1,700 rev/min corresponds to the improvement in the second adapting device, according to the illustrative embodiment of FIG. 1.

This adaptation can also be achieved according to FIG. 2 by a full-load stop designed as plate spring 25. However, another profile of the control-rod travel is obtained because of the plate spring 25 mounted on the stud bolt 7. The dash-dotted characteristic curve in FIG. 3 increases from the negative adapting end-point onwards. Moreover, the dashed characteristic curve indicates the profile without the adaptation "oA" according to the invention.

Figure 4:
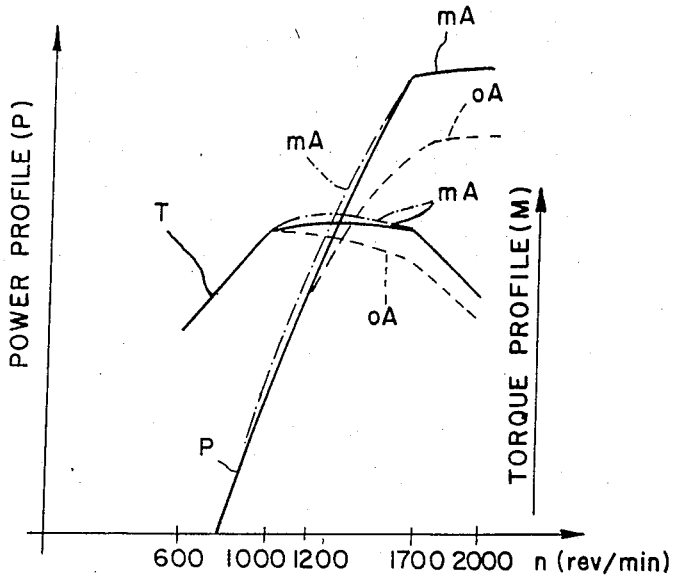
FIG. 4 is a graphical depiction which shows the torque profile and the power profile, in each case for both illustrative embodiments according to the present invention, and the profile without adaptation.

The characteristic curves are shown in detail in FIG. 4; those for the torque profile are designated T and those for the power profile are designated "P", with the dash-dotted characteristic curves reproducing the embodiment according to FIG. 2, the continuous characteristic curves reproducing the embodiment according to FIG. 1 (in each case with adaptation) and the dash characteristic curves reproducing the profile without adaptation.

It can be seen from the torque profile shown in FIG. 4 with adaptation "mA" according to the invention that, in contrast to the torque profile without adaptation "oA", the torque increases between the speeds of about 1,200 to 1,700 rev/min and at the same time is also connected with an improvement in power output. Thus, when speed is falling (starting from maximum speeds) an at least approximately uniform power output continues to be available which makes it unnecessary to change down into the lower gear, as can be seen from the power curve.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. Injection pump governor device for controlling a movable fuel injection pump control rod means, comprising:

diaphragm means connected to and movable with said control rod means, pressure medium communicating means for communicating engine supercharging pressure to said diaphragm means to force the diaphragm means and control rod means in a direction corresponding to increasing fuel pumping with increasing supercharging pressure, follower means mounted on and abuttingly engaging said control rod means on a first side of said diaphragm means proximate said pressure medium communicating means, full load stop means slidably mounted on and abuttingly engageable with said follower means onsaid first side of said diaphragm means for defining an end point of a first range of movement, first adapting means disposed on a second side of the diaphragm means remote from said pressure medium communicating means and engaging said diaphragm means for resiliently resisting movement of the control rod means over said first range of movement corresponding to a first predetermined range of engine speeds, and second adapting means disposed on said first side of the diaphragm means and operatively engaging said full load stop means with said follower means to move said full load stop means through a second range of movement only after completion of said first range of movement and corresponding to a second predetermined range of engine speeds that is higher than said first range of engine speeds.

2. An injection pump governor device according to claim 1, wherein said second adapting means comprises secondary biasing means, said secondary biasing means being capable of applying a biasing force against said full load stop means.

3. An injection pump governor device according to claim 1, further comprising housing means and cover means, said diaphragm means being clamped in an air tight manner between said housing means and cover means.

4. An injection pump governor device according to claim 1, wherein said control rod means comprises stud bolt means.

5. An injection pump governor device according to claim 1, wherein said full load stop means comprises stop bushing means around said control rod means.

6. An injection pump governor device according to claim 2, wherein said secondary biasing means comprises compression spring means and said full load stop means comprises stop bushing means, said compression spring means being capable of exerting a biasing force on said stop bushing means.

7. An injection pump governor device according to claim 6, wherein movement of said stop bushing means is limited by wall section means of cover means.

8. An injection pump governor device according to claim 2, wherein said secondary biasing means comprises plate spring means.

9. An injection pump governor device according to claim 8, wherein said control rod means comprises stud bolt means, said plate spring means being displaceable mounted on said stud means.

10. An injection pump governor device according to claim 3, wherein said second adapting means is arranged in said cover means.

11. An injection pump governor device according to claim 5, wherein said stop bushing means includes inner collar means and outer collar means, said second adapting means comprising compression spring means capable of biasing said stop bushing means, said compression spring means being capable of abutting said inner collar means.

12. An injection pump governor device according to claim 11, including bushing means connected to cover means of said spring loaded diaphragm means, said outer collar means capable of contacting said bushing means.

13. An injection pump governor device according to claim 6, wherein said compression spring means is guided in said stop bushing means.

* * * * *